US010209644B2

(12) United States Patent
Kitagawa et al.

(10) Patent No.: US 10,209,644 B2
(45) Date of Patent: Feb. 19, 2019

(54) TONER CASE AND IMAGE FORMING APPARATUS

(71) Applicant: KYOCERA Document Solutions Inc., Osaka (JP)

(72) Inventors: Hiroaki Kitagawa, Osaka (JP); Teruyuki Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/791,480

(22) Filed: Oct. 24, 2017

(65) Prior Publication Data

US 2018/0120735 A1 May 3, 2018

(30) Foreign Application Priority Data

Nov. 1, 2016 (JP) ..... 2016-214624

(51) Int. Cl.
*G03G 15/08* (2006.01)

(52) U.S. Cl.
CPC ..... *G03G 15/0886* (2013.01); *G03G 15/0875* (2013.01); *G03G 15/0891* (2013.01)

(58) Field of Classification Search
CPC ..... G03G 15/0886; G03G 15/0877; G03G 15/0865; G03G 15/0872; G03G 21/1676
See application file for complete search history.

(56) References Cited

U.S. PATENT DOCUMENTS 5,933,691 A * 8/1999 Johroku ..... G03G 15/0855 222/DIG. 1
2013/0028631 A1* 1/2013 Sato ..... G03G 15/0126 399/110
2016/0085178 A1* 3/2016 Kawasumi ..... G03G 15/0841 399/106

FOREIGN PATENT DOCUMENTS

JP 2001-305841 A 11/2001

OTHER PUBLICATIONS

Translation of Isomura (JP 2004-333608 A), publication date: Nov. 25, 2004.*
Translation of Tanio (JP 2014-206757 A), publication date: Oct. 14, 2014.*

* cited by examiner

*Primary Examiner* — Walter L Lindsay, Jr.
*Assistant Examiner* — Frederick Wenderoth
(74) *Attorney, Agent, or Firm* — Studebaker & Brackett PC

(57) ABSTRACT

A toner case includes a case main body, a rotator, a transmitter and a shutter. The case main body has a discharge port through which a toner is discharged. The rotator is stored in the case main body and rotates around a rotation axis. The transmitter transmits rotation to the rotator. At least a part of the transmitter is exposed to an outside of the case main body. The shutter is rotatable between a closing position where the shutter closes the discharge port and an opening position where the shutter opens the discharge port. The transmitter is movable between a first position and a second position which is arranged at an outside of the first position in a rotation axis direction of the rotator. The transmitter moves from the first position to the second position as the shutter rotates from the closing position to the opening position.

12 Claims, 13 Drawing Sheets

TONER CASE AND IMAGE FORMING APPARATUS

INCORPORATION BY REFERENCE

This application is based on and claims the benefit of priority from Japanese Patent application No. 2016-214624 filed on Nov. 1, 2016, which is incorporated by reference in its entirety.

BACKGROUND

The present disclosure relates to a toner case and an image forming apparatus including the toner case.

An image forming apparatus, such as a printer, a copying machine, a facsimile and a multifunctional peripheral, includes a toner case which replenishes a developing device with a toner (a developer). For instance, the toner case includes a case main body having a discharge port through which the toner is discharged, a rotator stored in the case main body and rotating around a rotation axis and a transmitter which is exposed to an outside of the case main body and transmits rotation to the rotator. In such a toner case, by transmitting the rotation from the transmitter to the rotator in a state where the discharge port is opened, the toner in the case main body is conveyed toward the discharge port and discharged outside the case main body.

SUMMARY

In accordance with an aspect of the present disclosure, a toner case includes a case main body, a rotator, a transmitter and a shutter. The case main body has a discharge port through which a toner is discharged. The rotator is stored in the case main body and rotates around a rotation axis. The transmitter transmits rotation to the rotator. At least a part of the transmitter is exposed to an outside of the case main body. The shutter is rotatable between a closing position where the shutter closes the discharge port and an opening position where the shutter opens the discharge port. The transmitter is movable between a first position and a second position which is arranged at an outside of the first position in a rotation axis direction of the rotator. The transmitter moves from the first position to the second position as the shutter rotates from the closing position to the opening position.

In accordance with an aspect of the present disclosure, an image forming apparatus includes the above toner case and an attachment part to which the toner case is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a multifunctional peripheral 1 (an example of an image forming apparatus) according to an embodiment of the present disclosure will be described. Arrows Fr, Rr, L, R, U and Lo shown in each figure respectively indicate a front side, a rear side, a left side, a right side, an upper side and a lower side of the multifunctional peripheral 1.

Firstly, an entire structure of the multifunctional peripheral 1 will be described.

Figure 1:
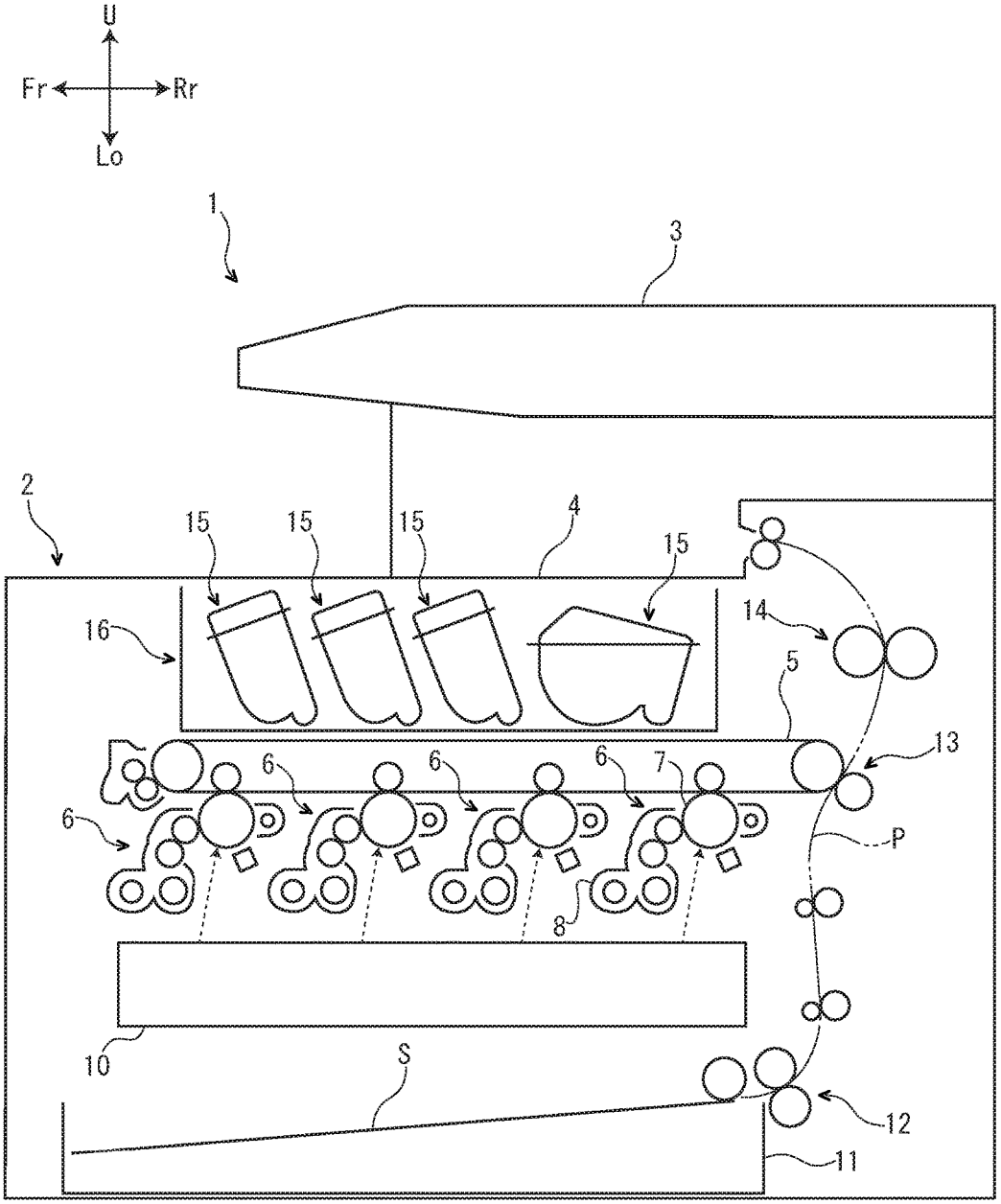
FIG. 1 is a schematic view showing a multifunctional peripheral according to an embodiment of the present disclosure.

As shown in FIG. 1, the multifunctional peripheral 1 includes a box-shaped multifunctional peripheral main body 2 (an example of an apparatus main body). On an upper end of the multifunctional peripheral main body 2, an image reading device 3 configured to read a document image is provided. In an upper portion of the multifunctional peripheral main body 2, an ejected sheet tray 4 is provided. In an approximate center portion of the multifunctional peripheral main body 2, an intermediate transferring belt 5 and four image forming parts 6 are stored. Each image forming part 6 corresponds to a toner (a developer) of black, cyan, magenta and yellow, in this order from the rear side. Each image forming part 6 includes a photosensitive drum 7 (an example of an image carrier) and a developing device 8. In a lower portion of the multifunctional peripheral main body 2, an exposing device 10 is stored. In a lower end portion of the multifunctional peripheral main body 2, a sheet feeding cassette 11 which stores a sheet S (an example of a recording medium) is stored.

In a rear side portion of the multifunctional peripheral main body 2, a conveying path P for the sheet S is provided.

At an upstream end of the conveying path P, a sheet feeding part 12 is provided. At a middle portion of the conveying path P, a secondary transferring part 13 is provided. At a downstream portion of the conveying path P, a fixing device 14 is provided.

In the upper portion of the multifunctional peripheral main body 2, four toner containers 15 (an example of toner cases) are provided under the ejected sheet tray 4. Each toner container 15 corresponds to the toner of black, cyan, magenta and yellow, in this order from the rear side. Each toner container 15 is detachably attached to an attachment part 16 provided at the upper portion of the multifunctional peripheral main body 2.

Next, an operation of the multifunctional peripheral 1 will be described.

Firstly, light (refer to a dotted line arrow in FIG. 1) emitted from the exposing device 10 exposes the photosensitive drum 7 of each image forming part 6 to form an electrostatic latent image on the photosensitive drum 7. The electrostatic latent image is developed by the developing device 8 of each image forming part 6. Thereby, a toner image is carried on the photosensitive drum 7. The toner image is primarily transferred on the intermediate transferring belt 5 from the photosensitive drum 7 of each image forming part 6. Thereby, a full color toner image is formed on the intermediate transferring belt 5.

The sheet S fed from the sheet feeding cassette 11 by the sheet feeding part 12 is conveyed to the downstream side along the conveying path P and enters the secondary transferring part 13. At the secondary transferring part 13, the full color toner image formed on the intermediate transferring belt 5 is secondarily transferred on the sheet S. The sheet S on which the toner image is transferred is conveyed to the downstream side along the conveying path P and enters the fixing device 14. The fixing device 14 fixes the toner image on the sheet S. The sheet S on which the toner image is fixed is ejected on the ejected sheet tray 4.

Next, each toner container 15 will be described in detail.

Figure 2:
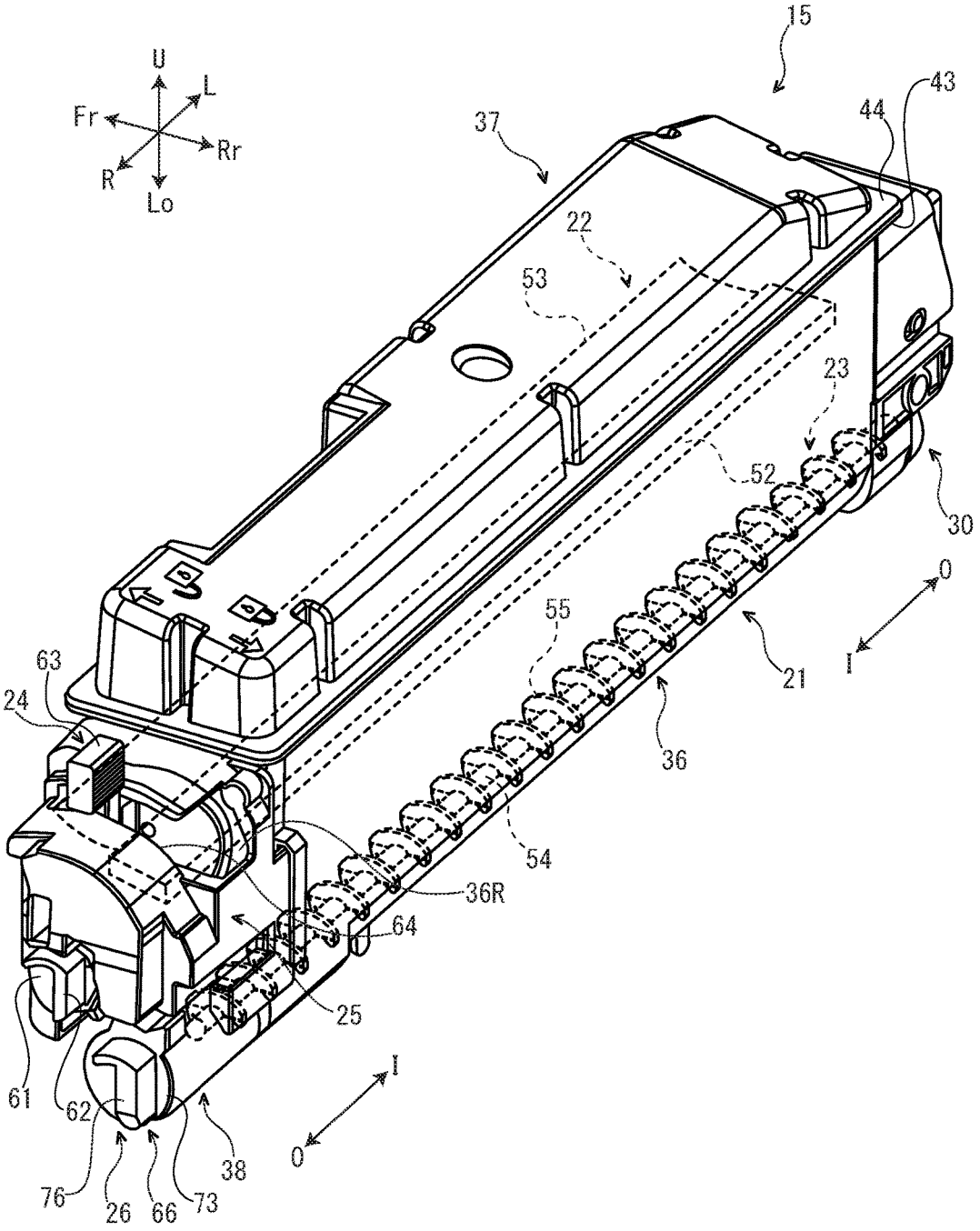
FIG. 2 is a perspective view showing a toner container according to the embodiment of the present disclosure.

An arrow O shown in each figure after FIG. 2 indicates an outside in the left-and-right direction of each toner container 15, and an arrow I shown in each figure after FIG. 2 indicates an inside in the left-and-right direction of each toner container 15.

Figure 3:
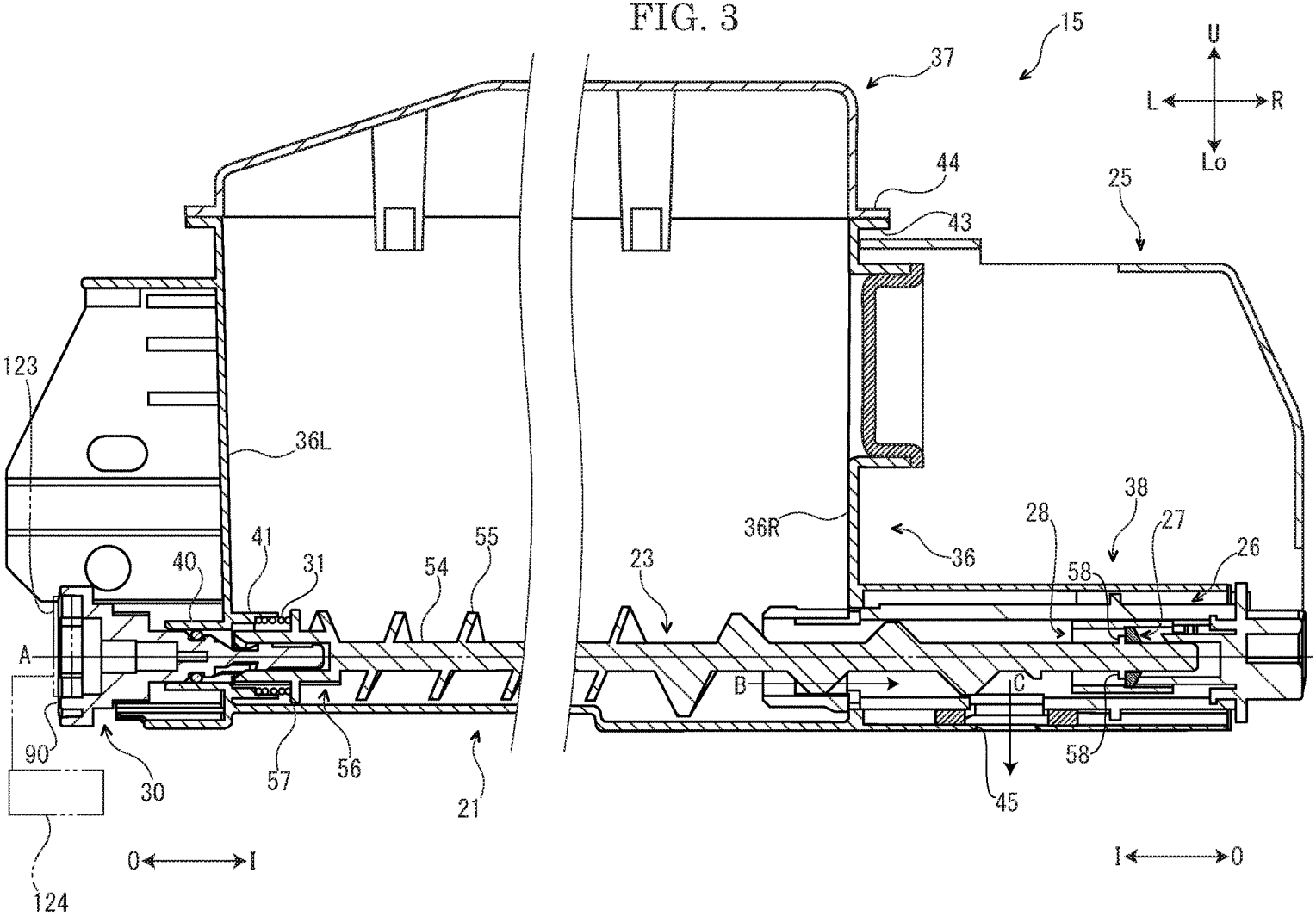
FIG. 3 is a sectional view showing the toner container according to the embodiment of the present disclosure.

With reference to FIG. 2 and FIG. 3, each toner container 15 includes a case main body 21, an agitator 22 stored in a center portion of the case main body 21, a conveyer 23 (an example of a rotator) stored in a rear lower portion of the case main body 21, a lever 24 (an example of a manipulation member) arranged at the right end side of the case main body 21, a cover 25 provided so as to cover the lever 24, a shutter 26 arranged at the lower side of the cover 25, a mover 27 and a fixing member 28 stored at a right side portion of the shutter 26, a transmitter 30 arranged at the left end side of the case main body 21 and a coil spring 31 (an example of a biasing member) arranged at the right side of the transmitter 30.

The case main body 21 of each toner container 15 stores the toner (the developer). The case main body 21 includes a storage 36, a lid 37 provided at the upper side of the storage 36 and a duct 38 provided at the right lower side of the storage 36.

The storage 36 of the case main body 21 is formed in a box-like shape whose upper side is opened. The storage 36 is elongated in the left-and-right direction. On a lower portion of a left side wall 36L of the storage 36, an outer cylindrical part 40 is protruded toward the left side (the outside in the left-and-right direction) and an inner cylindrical part 41 is protruded toward the right side (the inside in the left-and-right direction). The outer cylindrical part 40 and the inner cylindrical part 41 are formed in a cylindrical shape elongated along the left-and-right direction. Around an upper end of an outer circumference of the storage 36, a lower side flange portion 43 is provided.

The lid 37 of the case main body 21 is formed in a box-like shape whose lower side is opened. Around a lower end of an outer circumference of the lid 37, an upper side flange portion 44 is provided. The upper side flange portion 44 is fixed to the lower side flange portion 43 of the storage 36. Thereby, the lid 37 is integrated with the storage 36. An inner space of the lid 37 is communicated with an inner space of the storage 36.

Figure 4:
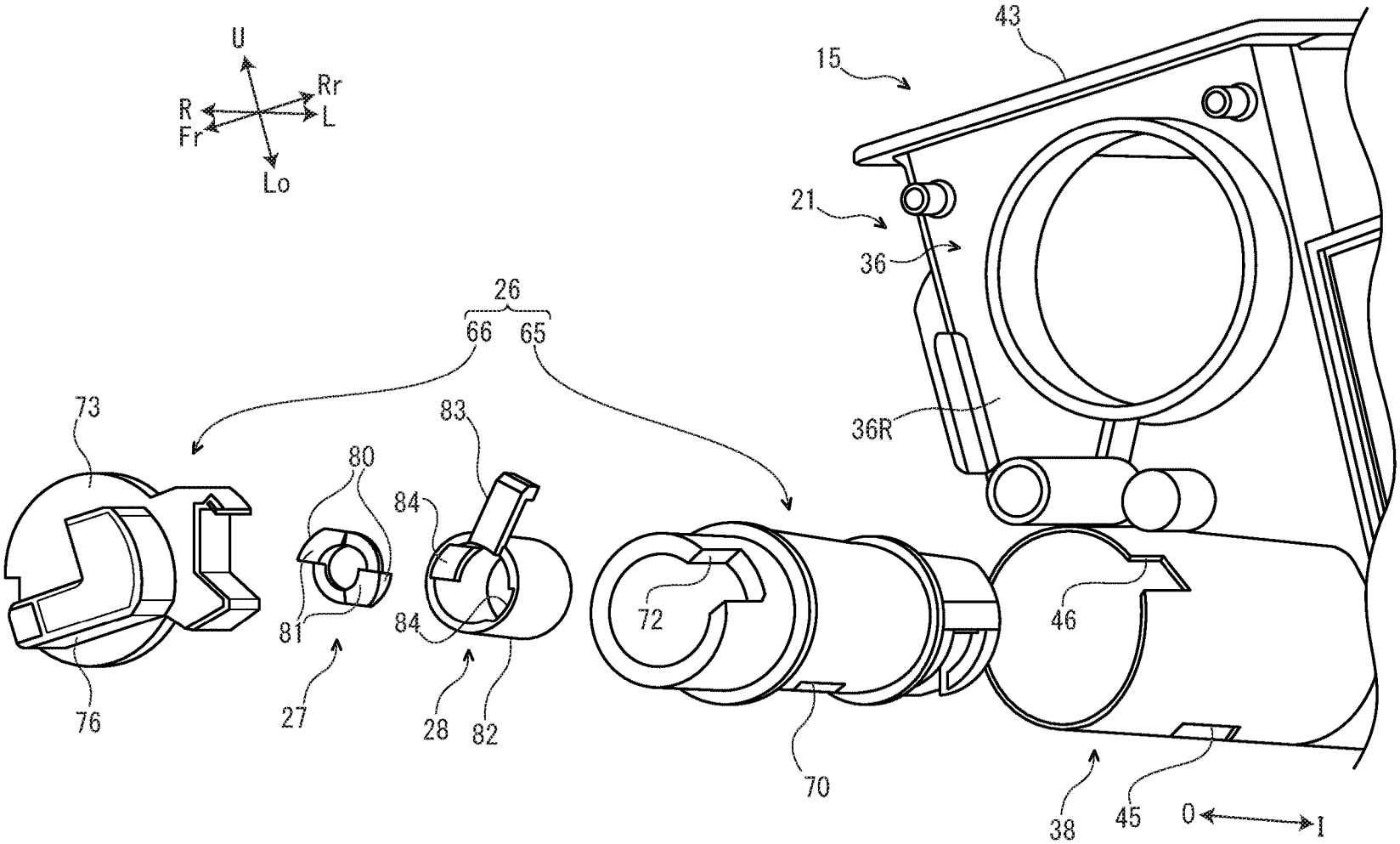
FIG. 4 is a disassembled perspective view showing a shutter and its vicinity, in the toner container according to the embodiment of the present embodiment.

With reference to FIG. 4, the duct 38 of the case main body 21 is formed in a cylindrical shape extending along the left-and-right direction. The duct 38 is formed integrally with the storage 36 of the case main body 21, and extends from a lower end portion of a right side wall 36R of the storage 36 toward the right side (the outside in the left-and-right direction). An inner space of the duct 38 is communicated with the inner space of the storage 36. On a lower face of the duct 38, a discharge port 45 through which the toner is discharged is provided. At a right edge (an edge at the outside in the left-and-right direction) of the duct 38, a rectangular fixing groove 46 is formed.

With reference to FIG. 2, the agitator 22 of each toner container 15 is stored in the storage 36 of the case main body 21. The agitator 22 is rotatable. The agitator 22 includes an agitating shaft 52 and an agitating blade 53 mounted to the agitating shaft 52. The agitating shaft 52 extends along the left-and-right direction. The agitating blade 53 is made of resin film, for example, and formed in a sheet-like shape.

With reference to FIG. 3, a left side portion and a center portion in the left-and-right direction of the conveyer 23 of each toner container 15 are stored in the storage 36 of the case main body 21. A right side portion of the conveyer 23 is stored in the duct 38 of the case main body 21. The conveyer 23 is rotatable around a rotation axis A extending along the left-and-right direction. That is, the left-and-right direction is a rotation axis direction of the conveyer 23. The conveyer 23 is movable along the left-and-right direction with respect to the case main body 21.

The conveyer 23 includes a conveying shaft 54 extending along the left-and-right direction and a spiral conveying fin 55 protruding on an outer circumference of the conveying shaft 54. On a left end portion of the conveying shaft 54, a cylindrical shaped coupling cylindrical part 56 is provided. On an outer circumferential face of the coupling cylindrical part 56, an annular platform portion 57 is protruded. On an outer circumferential face of a right side portion of the conveying shaft 54, a plurality of (for example, four) projections 58 are provided at equal intervals in a circumferential direction.

With reference to FIG. 2, the lever 24 of each toner container 15 is arranged at the right side (the outside in the left-and-right direction) of the case main body 21. The lever 24 includes a fulcrum part 61, a drive protruding part 62 protruding on a right face (a face at the outside in the left-and-right direction) of the fulcrum part 61 and a manipulated part 63 (only its upper end portion is shown in FIG. 2) extending upward from the fulcrum part 61. The lever 24 is supported by the right side wall 36R of the storage 36 of the case main body 21 so as to be rotatable around the fulcrum part 61.

The cover 25 of each toner container 15 is fixed to the storage 36 of the case main body 21, and covers the right side wall 36R of the storage 36 from the right side (the outside in the left-and-right direction). In an upper portion of the cover 25, a window 64 is provided. Through the window 64, the upper end portion of the manipulated part 63 of the lever 24 is exposed to an outside of each toner container 15.

Figure 5:
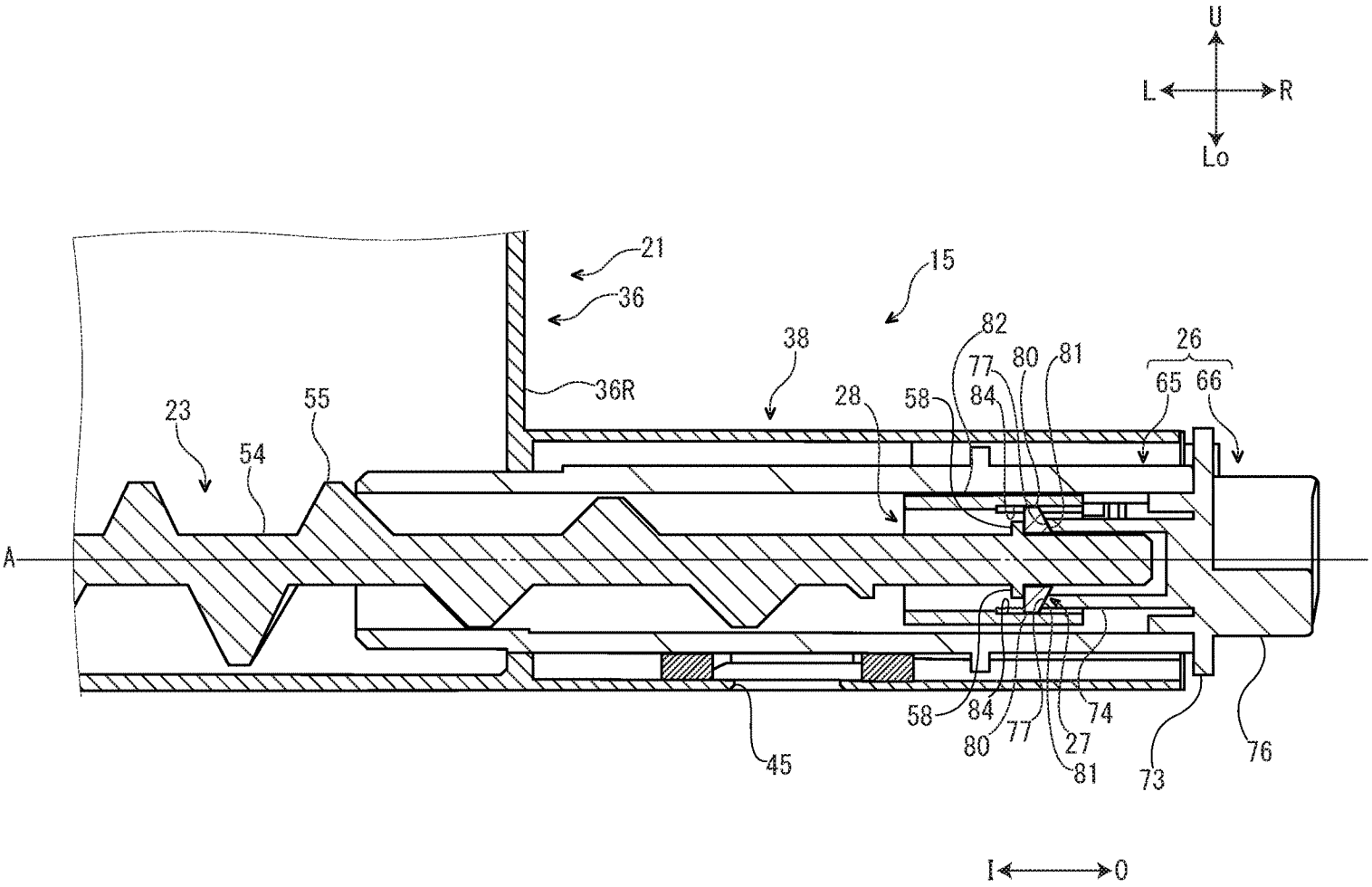
FIG. 5 is a sectional view showing a state where the shutter is rotated to a closing position, in the toner container according to the embodiment of the present disclosure.
Figure 6:
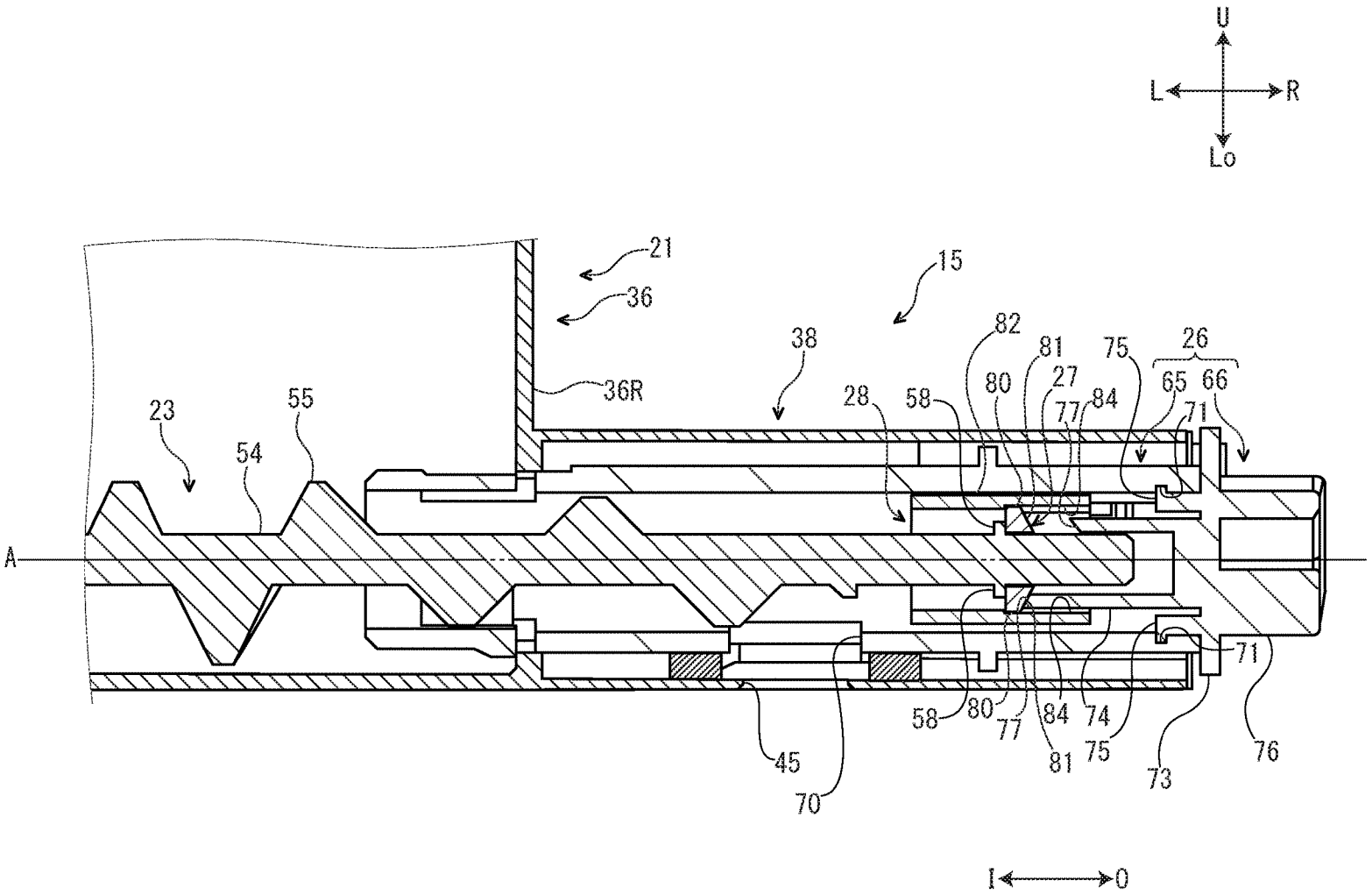
FIG. 6 is a sectional view showing a state where the shutter is rotated to an opening position, in the toner container according to the embodiment of the present disclosure.

The shutter 26 of each toner container 15 is arranged at the right end side of the conveyer 23. With reference to FIG. 4 to FIG. 6, the shutter 26 includes a main body part 65 and a closing part 66 attached to a right end portion (an end portion at the outside in the left-and-right direction) of the main body part 65.

The main body part 65 of the shutter 26 is formed in a cylindrical shape extending along the left-and-right direction. In the main body part 65, the right side portion of the conveyer 23 is stored. The main body part 65 is rotatably attached to an inner circumference of the duct 38. Thereby, the shutter 26 is rotatable between a closing position (refer to FIG. 5) where the main body part 65 closes the discharge port 45 of the duct 38 and an opening position (refer to FIG. 6) where the main body part 65 opens the discharge port 45 of the duct 38. Hereinafter, a rotating direction of the shutter 26 from the closing position to the opening position is called as a rotating direction RD (refer to FIG. 7).

With reference to FIG. 4 to FIG. 6, the main body part 65 of the shutter 26 has a communication port 70. The communication port 70 is not communicated with the discharge port 45 of the duct 38 in a state where the shutter 26 is rotated to the closing position, and is communicated with the discharge port 45 of the duct 38 in a state where the shutter 26 is rotated to the opening position. On an inner circumferential face of the main body part 65, a pair of fitting grooves 71 (refer to FIG. 6) is formed. At a right edge (an edge at the outside in the left-and-right direction) of the main body part 65, a rectangular guide groove 72 (refer to FIG. 4) is provided.

With reference to FIG. 5 to FIG. 8, the closing part 66 of the shutter 26 includes a flat plate part 73, a supporting cylindrical part 74 and a pair of fitting protruding parts 75 which are protruded on a left face (a face at the inside in the left-and-right direction) of the flat plate part 73, and a driven protruding part 76 protruding on a right face (a face at the outside in the left-and-right direction) of the flat plate part 73.

The flat plate part 73 of the closing part 66 of the shutter 26 is formed in a flat plate-like shape along a face perpendicular to the left-and-right direction. The flat plate part 73 closes the right end portion (the end portion at the outside in the left-and-right direction) of the main body part 65 of the shutter 26.

Into the supporting cylindrical part 74 of the closing part 66 of the shutter 26, a right end portion of the conveying shaft 54 of the conveyer 23 is rotatably inserted. On a left end face (an end face at the inside in the left-and-right direction) of the supporting cylindrical part 74, a pair of pressing faces 77 is formed. The pressing faces 77 are provided at intervals in a circumferential direction, and arranged at diagonal positions. Each pressing face 77 is inclined to the left side (one side in the left-and-right direction) from a downstream side to an upstream side in the rotating direction RD.

The pair of fitting protruding parts 75 of the closing part 66 of the shutter 26 faces an outer circumferential face of the supporting cylindrical part 74 of the closing part 66 of the shutter 26 with an interval. The pair of fitting protruding parts 75 is fitted into the pair of fitting grooves 71 provided on the inner circumferential face of the main body part 65 of the shutter 26. Thereby, the closing part 66 is fixed to the main body part 65.

Figure 7:
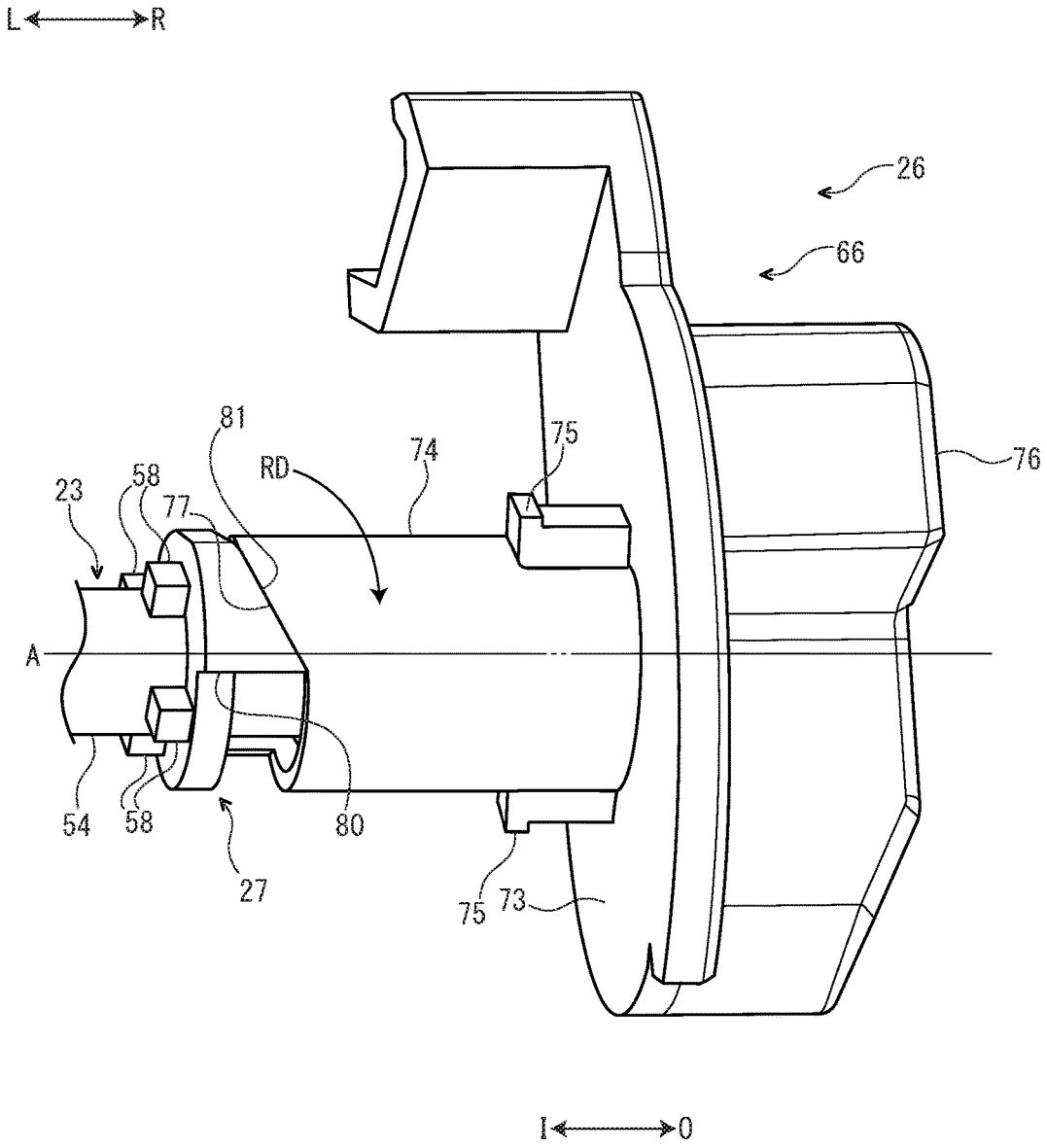
FIG. 7 is a perspective view showing the state where the shutter is rotated to the closing position, in the toner container according to the embodiment of the present disclosure.
Figure 8:
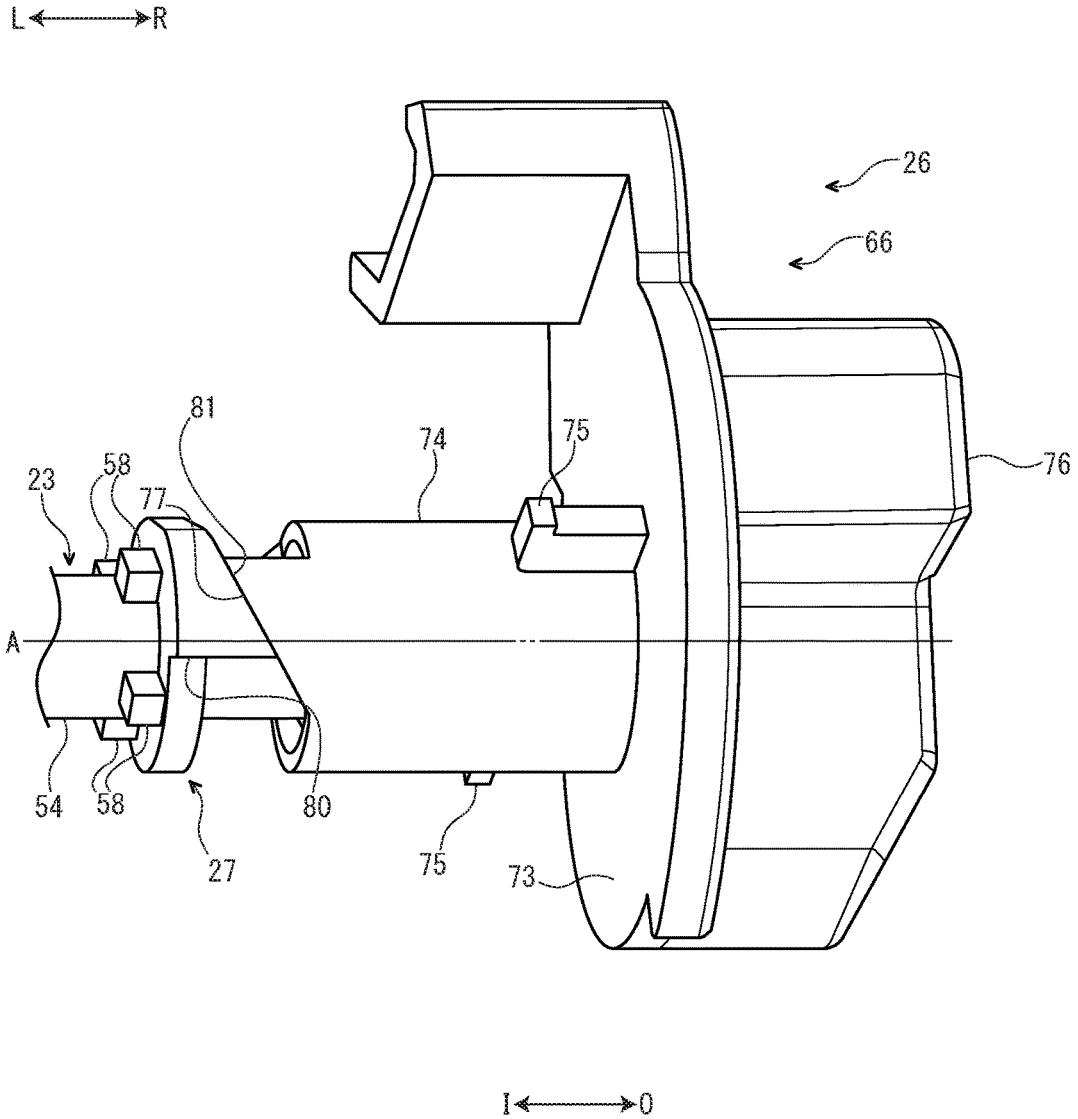
FIG. 8 is a perspective view showing the state where the shutter is rotated to the opening position, in the toner container according to the embodiment of the present disclosure.

With reference to FIG. 4, FIG. 7 and FIG. 8, the mover 27 of each toner container 15 is formed in an annular shape. The mover 27 is attached to the outer circumference of the conveying shaft 54 of the conveyer 23. A left face (a face at the inside in the left-and-right direction) of the mover 27 comes into contact with the plurality of projections 58 provided on the outer circumferential face of the conveying shaft 54.

Around an outer circumferential face of the mover 27, a pair of engagement projections 80 is provided. The engagement projections 80 are provided at intervals in a circumferential direction, and arranged at diagonal positions. On a right face (a face at the outside in the left-and-right direction) of the mover 27, a pair of pressed faces 81 is protruded. The pressed faces 81 are provided at intervals in the circumferential direction, and arranged at diagonal positions. The pair of pressed faces 81 is arranged so as to be overlapped with the pair of engagement projections 80 in the circumferential direction. Each pressed face 81 is inclined to the left side (one side in the left-and-right direction) from the downstream side to the upstream side in the rotating direction RD.

With reference to FIG. 4, the fixing member 28 of each toner container 15 includes a storage piece 82 and a fixing piece 83 protruding from a right end portion (an end portion at the outside in the left-and-right direction) of the storage piece 82 outwardly in a radial direction.

With reference to FIG. 4 to FIG. 6, the storage piece 82 of the fixing member 28 is formed in a cylindrical shape. The storage piece 82 is inserted in the main body part 65 of the shutter 26. In the storage piece 82, the mover 27 is stored. On an inner circumferential face of the storage piece 82, a pair of engagement grooves 84 is provided. The engagement grooves 84 are provided at intervals in a circumferential direction, and arranged at diagonal positions. With the pair of engagement grooves 84, the pair of engagement projections 80 provided on the outer circumferential face of the mover 27 is engaged in a slidable state along the left-and-right direction. Thereby, a moving direction of the mover 27 is restricted by the fixing member 28, and the mover 27 is allowed to be moved along the left-and-right direction.

Figure 9:
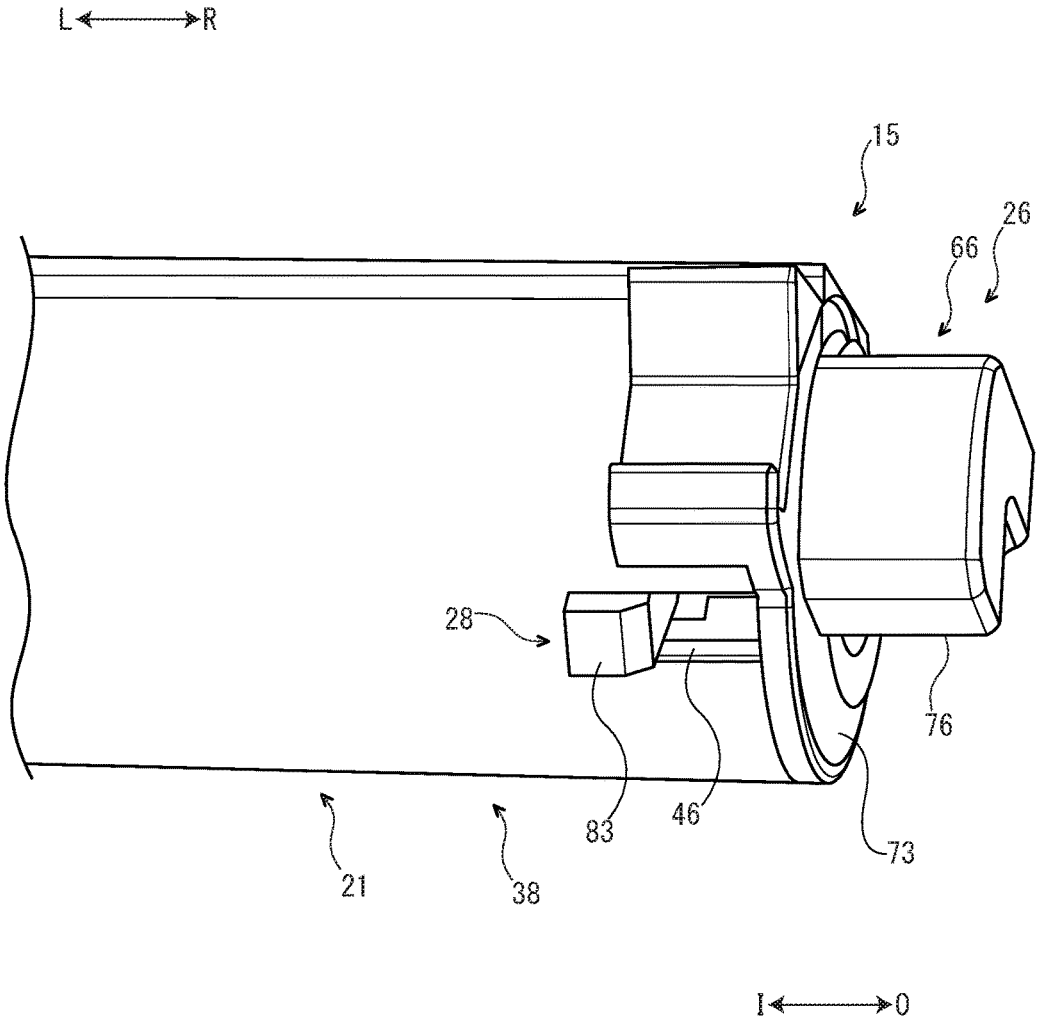
FIG. 9 is a perspective view showing a duct of a case main body and its vicinity, in the toner container according to the embodiment of the present disclosure.

With reference to FIG. 9, the fixing piece 83 of the fixing member 28 is engaged with the fixing groove 46 provided on the duct 38 of the case main body 21. Thereby, the fixing member 28 is fixed to the case main body 21, and the fixing member 28 is restricted from being rotated with respect to the case main body 21. Consequently, the mover 27 is restricted from being rotated with respect to the case main body 21.

Figure 10:
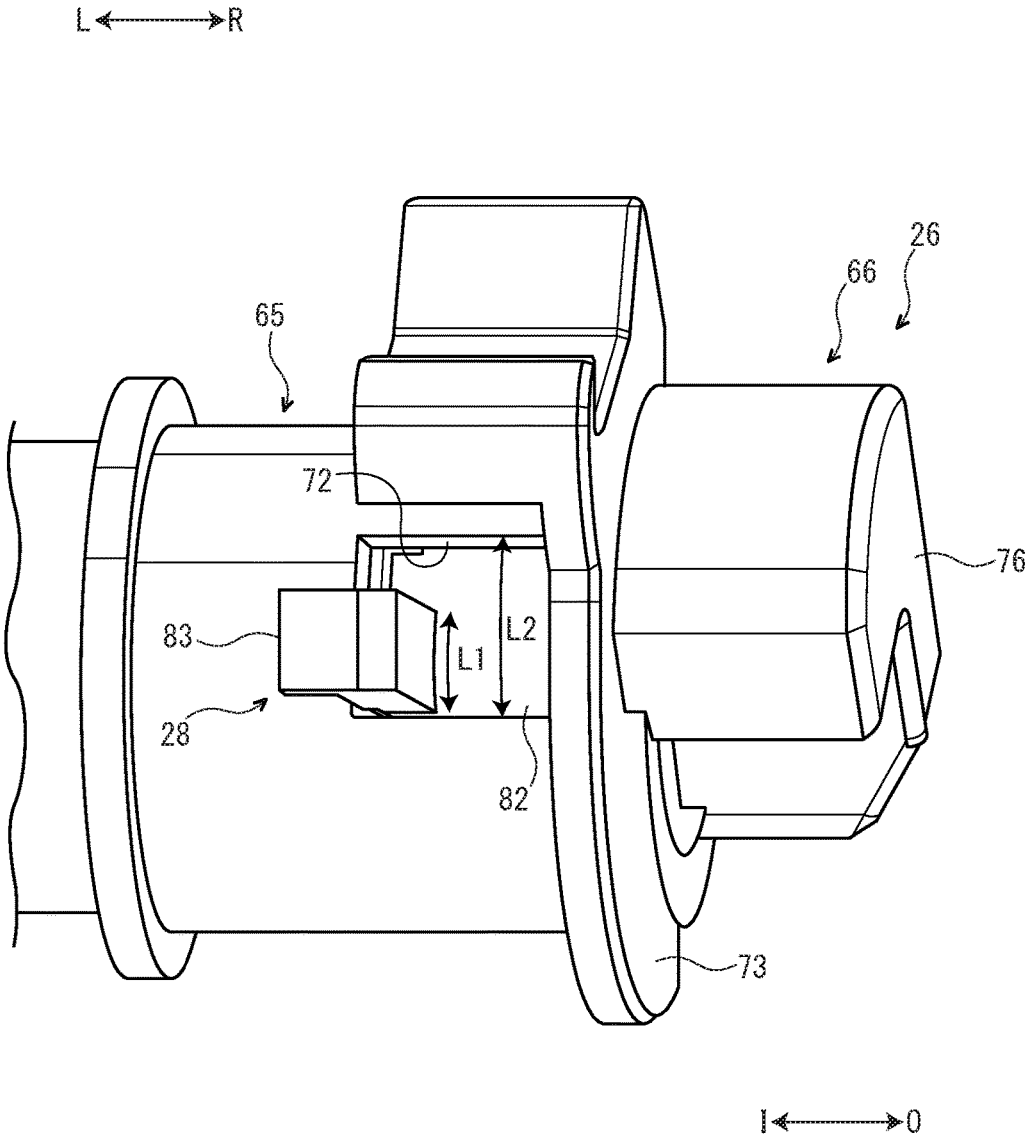
FIG. 10 is a perspective view showing the shutter and its vicinity, in the toner container according to the embodiment of the present disclosure.

With reference to FIG. 10, the fixing piece 83 of the fixing member 28 penetrates the guide groove 72 provided in the main body part 65 of the shutter 26. Because a circumferential length L1 of the fixing piece 83 is shorter than a circumferential length L2 of the guide groove 72, the shutter 26 is rotatable with respect to the fixing member 28 by a difference between the length L2 and the length L1.

Figure 11:
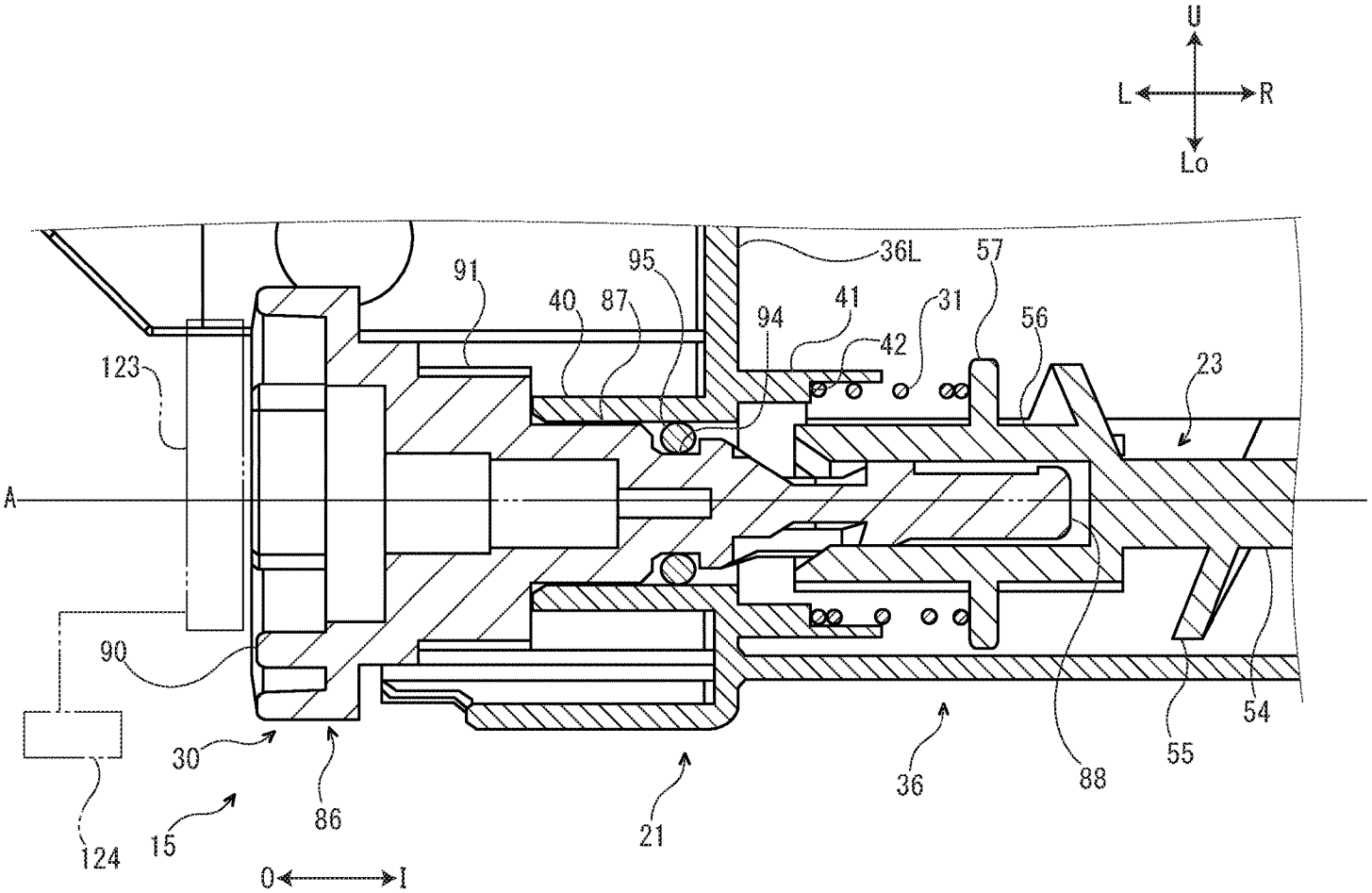
FIG. 11 is a sectional view showing a state where a transmitter is moved to a first position, in the toner container according to the embodiment of the present disclosure.
Figure 12:
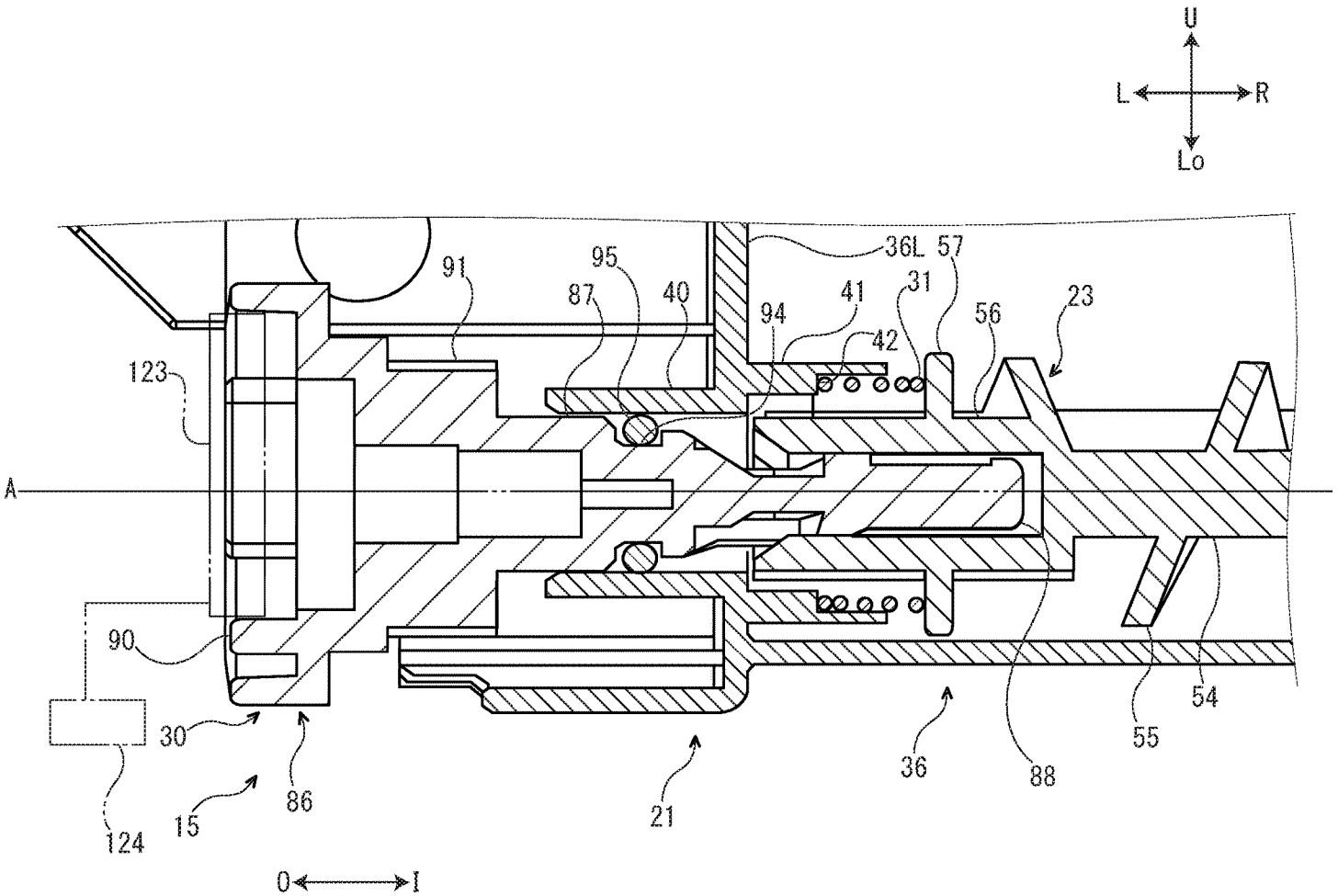
FIG. 12 is a sectional view showing a state where the transmitter is moved to a second position, in the toner container according to the embodiment of the present disclosure.

With reference to FIG. 11 and FIG. 12, the transmitter 30 of each toner container 15 is arranged on the left end side of the conveyer 23. The transmitter 30 penetrates through the outer cylindrical part 40 and the inner cylindrical part 41 which are provided on the left side wall 36L of the storage 36 of the case main body 21.

The transmitter 30 is movable along the left-and-right direction between a first position (refer to FIG. 11) and a second position (refer to FIG. 12) which is arranged at the left side (the outside in the left-and-right direction) of the first position. The transmitter 30 is rotatable around the rotation axis A.

The transmitter 30 includes an annular exposed piece 86, an inserted piece 87 protruding to the right side (the inside in the left-and-right direction) from the exposed piece 86 and a coupled piece 88 protruding to the right side (the inside in the left-and-right direction) from the inserted piece 87.

The exposed piece 86 of the transmitter 30 is exposed to the outside of the case main body 21. On a left face (a face at the outside in the left-and-right direction) of the exposed piece 86, a transmitting coupling 90 is provided. Around an outer circumferential face of the exposed piece 86, a transmitting gear 91 is provided. The transmitting gear 91 is connected to the agitating shaft 52 of the agitator 22 (refer to FIG. 2) via a connecting gear (not shown).

With reference to FIG. 11 and FIG. 12, the inserted piece 87 of the transmitter 30 is inserted into the outer cylindrical part 40 provided on the left side wall 36L of the storage 36 of the case main body 21. Around an outer circumferential face of the inserted piece 87, an annular attachment groove 94 is provided, and an annular seal member 95 is fitted in the attachment groove 94. The seal member 95 comes into contact with an inner circumferential face of the outer cylindrical part 40.

The coupled piece 88 of the transmitter 30 is inserted into the coupling cylindrical part 56 of the conveying shaft 54 of the conveyer 23, and coupled to the coupling cylindrical part 56. Thereby, the transmitter 30 is fixed to the left end portion of the conveying shaft 54.

The coil spring 31 of each toner container 15 is arranged at the left end side of the conveyer 23. The coil spring 31 is mounted around the coupling cylindrical part 56 of the conveying shaft 54 of the conveyer 23. The coil spring 31 is arranged at an inner circumference side of the inner cylindrical part 41 provided on the left side wall 36L of the storage 36 of the case main body 21. The coil spring 31 is interposed between a step portion 42 formed on the inner circumferential face of the inner cylindrical part 41 and the platform portion 57 protruding on the outer circumferential face of the coupling cylindrical part 56. The coil spring 31 presses the conveyer 23 to the right side (another side in the left-and-right direction) to bias the transmitter 30 fixed to the conveyer 23 to the first position (refer to FIG. 11).

Next, the attachment part 16 will be described in detail.

Figure 13:
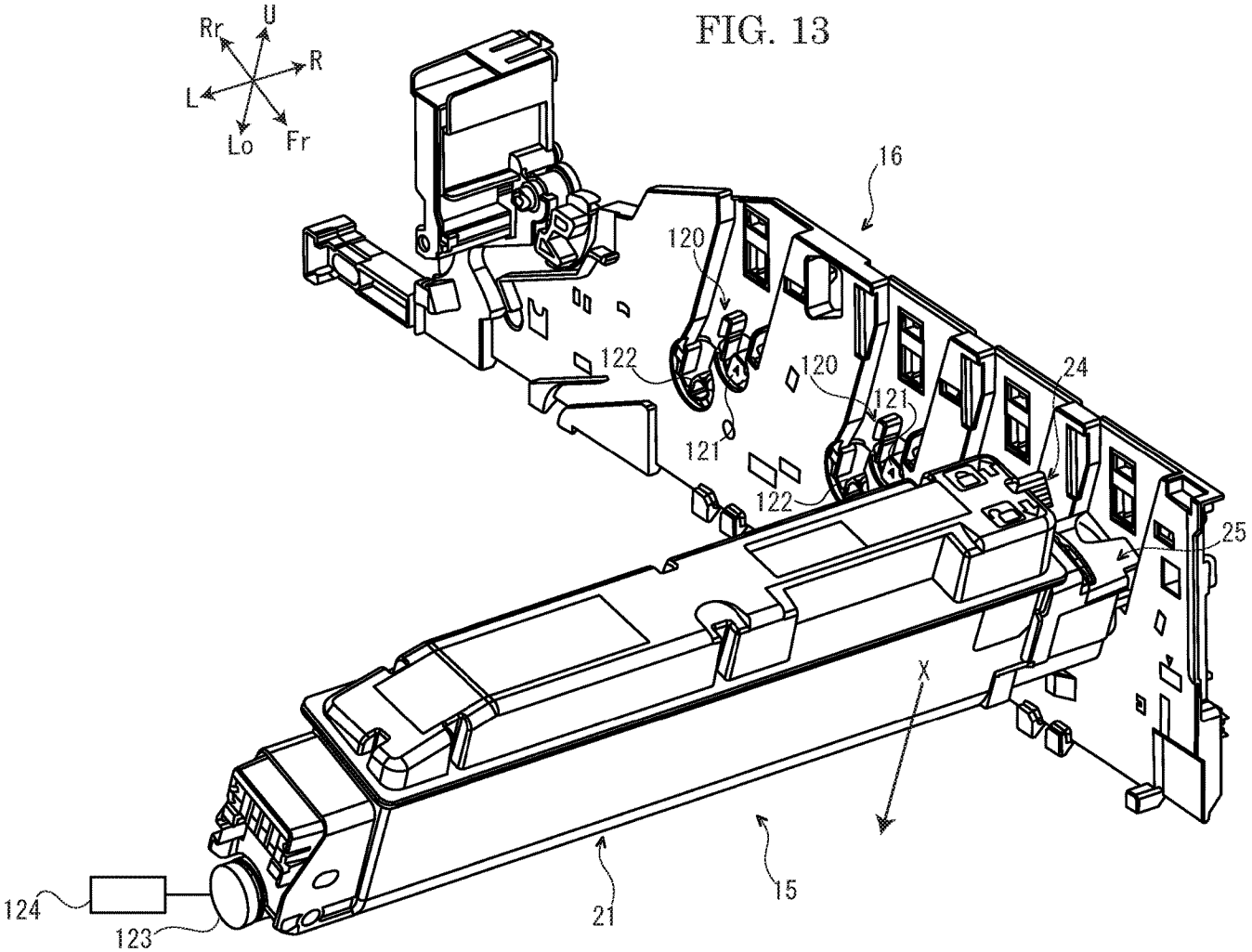
FIG. 13 is a perspective view showing the toner container and an attachment part, in the multifunctional peripheral according to the embodiment of the present disclosure.

With reference to FIG. 13, to the attachment part 16, each toner container 15 (one of them is only shown in FIG. 13) is detachably attached along an attachment direction X from the upper side to the lower side. In the attachment part 16, four connecting mechanisms 120 (two of them are only shown in FIG. 13) are provided at the right sides of attachment positions of the toner containers 15. Each connecting mechanism 120 includes a first connecting member 121 and a second connecting member 122 connected to the first connecting member 121 via a gear part (not shown). The first connecting member 121 is engaged with the drive protruding part 62 of the lever 24 of each toner container 15 in a state where each toner container 15 is attached to the attachment part 16. The second connecting member 122 is engaged with the driven protruding part 76 of the shutter 26 of each toner container 15 in the state where each toner container 15 is attached to the attachment part 16. As described above, each connecting mechanism 120 connects the lever 24 to the shutter 26 in the state where each toner container 15 is attached to the attachment part 16.

In the attachment part 16, four driving couplings 123 (one of them is only shown in FIG. 13) are provided at the left sides of the attachment positions of the toner containers 15. Each driving coupling 123 is connected to a driving source 124 constituted by a motor and the others, and configured to be driven by driving force from the driving source 124 to be rotated.

In the multifunctional peripheral 1 having the above described configuration, an operation to replenish the developing device 8 of the image forming part 6 with the toner from the toner container 15 will be described on an assumption that the toner container 15 is attached to the attachment part 16.

When the developing device 8 of the image forming part 6 is replenished with the toner from the toner container 15, in a state (refer to FIG. 3) where the transmitting coupling 90 of the toner container 15 is coupled to the driving coupling 123 and the discharge port 45 of the toner container 15 is opened, the driving source 124 is operated. When the driving source 124 is operated, the driving coupling 123 is rotated by driving force from the driving source 124. When the driving coupling 123 is rotated, rotation of the driving coupling 123 is transmitted to the agitating shaft 52 of the agitator 22 (refer to FIG. 2) by the transmitter 30 and the connecting gear (not shown) to rotate the agitator 22. Consequently, the toner stored in the storage 36 of the case main body 21 is agitated by the agitator 22.

Additionally, when the driving coupling 123 is rotated as described above, the rotation is transmitted to the conveyer 23 by the transmitter 30 to rotate the conveyer 23. Consequently, as shown by an arrow B in FIG. 3, the toner stored in the storage 36 and the duct 38 of the case main body 21 is conveyed by the conveyer 23 toward the discharge port 45. The toner conveyed toward the discharge port 45 is, as shown by an arrow C in FIG. 3, discharged outside the toner container 15 through the discharge port 45. The toner discharged through the discharge port 45 is replenished to the developing device 8 of each image forming part 6 through a replenishment duct (not shown).

Next, in the multifunctional peripheral 1 having the above described configuration, an operation to move the transmitter 30 with opening and closing of the discharge port 45 will be described on an assumption that the toner container 15 is attached to the attachment part 16.

When the shutter 26 is moved to the closing position, as shown in FIG. 5, the main body part 65 of the shutter 26 closes the discharge port 45. Additionally, as shown in FIG. 7, a position of the pressing faces 77 of the shutter 26 meets a position of the pressed faces 81 of the mover 27 in the circumferential direction. Furthermore, as shown in FIG. 11, the transmitter 30 is kept in the first position by biasing force of the coil spring 31.

In a state where the shutter 26 is moved to the closing position, when a worker, such as a user and a serviceman, rotates the lever 24 in one direction, rotation of the lever 24 is transmitted to the shutter 26 via the connecting mechanism 120 to rotate the shutter 26 from the closing position to the opening position. Thereby, as shown in FIG. 6, the main body part 65 of the shutter 26 opens the discharge port 45.

Additionally, as the shutter 26 is rotated from the closing position to the opening position, as shown in FIG. 8, the position of the pressing faces 77 of the shutter 26 is displaced from the position of the pressed faces 81 of the mover 27 in the circumferential direction. Consequentially, the pressing faces 77 of the shutter 26 press the pressed faces 81 of the mover 27 to the left side to move the mover 27 to the left side (one side in the left-and-right direction). Then, the mover 27 presses the plurality of projections 58 of the conveyer 23 to the left side to move the conveyer 23 to the left side (one side in the left-and-right direction). When the conveyer 23 is moved to the left side, as shown in FIG. 12, the transmitter 30 fixed to the conveyer 23 is moved from the first position to the second position against the biasing force of the coil spring 31. As a result, the transmitting coupling 90 of the transmitter 30 is coupled to the driving coupling 123 to restrict detachment of the toner container 15 from the attachment part 16.

On the other hand, in a state where the shutter 26 is moved to the opening position, when the worker rotates the lever 24 in an opposite direction to the above one direction, the rotation of the lever 24 is transmitted to the shutter 26 via the connecting mechanism 120 to rotate the shutter 26 from the opening position to the closing position. Thereby, as shown in FIG. 5, the main body part 65 of the shutter 26 closes the discharge port 45.

Additionally, as the shutter 26 is rotated from the opening position to the closing position as described above, as shown in FIG. 7, the position of the pressing faces 77 of the shutter 26 meets the position of the pressed faces 81 of the mover 27 in the circumferential direction. Consequently, by the biasing force of the coil spring 31, the conveyer 23 and the mover 27 are moved to the right side (another side in the left-and-right direction). When the conveyer 23 is moved to the right side, as shown in FIG. 11, the transmitter 30 fixed to the conveyer 23 is moved from the second position to the first position by the biasing force of the coil spring 31. As a result, the coupling of the transmitting coupling 90 of the transmitter 30 to the driving coupling 123 is released to allow the detachment of the toner container 15 from the attachment part 16.

In the present embodiment, as described above, the transmitter 30 is movable between the first position and the second position which is arranged at the left side (the outside in the left-and-right direction), and as the shutter 26 is rotated from the closing position to the opening position, the transmitter 30 is moved from the first position to the second position. By applying such a configuration, it becomes possible to move the transmitter 30 with the opening and closing of the discharge port 45 and it is therefore not necessary to prepare a dedicated member to move the transmitter 30. Accordingly, it becomes possible to move the transmitter 30 by a simple configuration.

Additionally, as the shutter 26 is rotated from the closing position to the opening position, the shutter 26 presses the mover 27 to move the mover 27 to the left side (one side in the left-and-right direction), the mover 27 presses the conveyer 23 to move the conveyer 23 to the left side and then the transmitter 30 fixed to the conveyer 23 is moved from the first position to the second position. By applying such a configuration, it becomes possible to move the transmitter 30 from the first position to the second position surely.

Additionally, the shutter 26 includes the pressing faces 77 inclined to the left side (one side in the left-and-right direction) from the downstream side to the upstream side in the rotating direction RD, the mover 27 includes the pressed faces 81 inclined to the left side from the downstream side to the upstream side in the rotating direction RD, and as the shutter 26 is rotated from the closing position to the opening position, the pressing faces 77 press the pressed faces 81 to move the mover 27 to the left side. By applying such a configuration, it becomes possible to move the mover 27 to the left side by a simple configuration.

Additionally, the pair of engagement grooves 84 is provided on the inner circumferential face of the fixing member 28, and the pair of engagement projections 80 which is engaged with the pair of engagement grooves 84 in a slidable state along the left-and-right direction is provided on the outer circumferential face of the mover 27. By applying such a configuration, it becomes possible to restrict the moving direction of the mover 27 by the fixing member 28 surely.

Additionally, as the shutter 26 is rotated from the opening position to the closing position, the transmitter 30 is moved from the second position to the first position by the biasing force of the coil spring 31. By applying such a configuration, it becomes possible to move the transmitter 30 from the second position to the first position surely as the shutter 26 is rotated from the opening position to the closing position.

Additionally, the transmitter 30 and the coil spring 31 are arranged at the left end side (one end side in the left-and-right direction) of the conveyer 23, and the shutter 26 is arranged at the right end side (another end side in the left-and-right direction) of the conveyer 23. By applying such a configuration, it becomes possible to separate the setting space for the transmitter 30 and the coil spring 31 from the setting space for the shutter 26 and to secure the setting spaces for such members easily.

Additionally, the case main body 21 includes the cylindrical duct 38 having the discharge port 45, a part of the conveyer 23 which conveys the toner in the case main body 21 toward the discharge port 45 is stored in the duct 38, and the shutter 26 is rotatably attached to the duct 38. By applying such a configuration, it becomes possible to rotate the shutter 26 smoothly.

Additionally, the multifunctional peripheral 1 includes the toner container 15 and the attachment part 16 to which the toner container 15 is detachably attached. By applying such a configuration, it becomes possible to replace the toner container 15 easily.

By the way, in some cases, with an opening and closing operation of a top cover (not shown) provided in the multifunctional peripheral main body 2 or the attachment operation of the toner container 15 to the attachment part 16, the driving coupling 123 is moved to be coupled to the transmitting coupling 90. However, to achieve such a configuration, the multifunctional peripheral main body 2 requires a driving mechanism to move the driving coupling 123, and therefore the multifunctional peripheral main body 2 may be complicated in its structure. Additionally, in a case where the driving coupling 123 is moved with the opening and closing operation of the top cover as described above, unless the top cover is completely opened, the coupling of the driving coupling 123 to the transmitting coupling 90 may not be released.

However, in the present embodiment, when the transmitter 30 is moved from the first position to the second position in the state where the toner container 15 is attached to the attachment part 16, the transmitting coupling 90 is coupled to the driving coupling 123. By applying such a configuration, the multifunctional peripheral main body 2 does not require the driving mechanism to move the driving coupling 123 so that it becomes possible to suppress the complication of the structure of the multifunctional peripheral main body 2 and to perform space saving of the multifunctional peripheral main body 2. Additionally, because it becomes possible to release the coupling of the driving coupling 123 to the transmitting coupling 90 regardless of the operation of the members provided on the multifunctional peripheral main body 2, such as the top cover, a workability for the attachment and detachment of the toner container 15 to the attachment part 16 is improved.

Additionally, when the lever 24 is rotated in the state where the toner container 15 is attached to the attachment part 16, the rotation of the lever 24 is transmitted to the shutter 26 via the connecting mechanism 120 to rotate the shutter 26. By applying such a configuration, when the worker rotates the lever 24, it becomes possible to open and close the discharge port 45 and to move the driving coupling 123 at the same time. This makes it possible to reduce work load of the worker.

In the present embodiment, the pair of engagement grooves 84 is provided on the inner circumferential face of the fixing member 28 and the pair of engagement projections 80 is provided on the outer circumferential face of the mover 27. On the other hand, in another embodiment, the pair of engagement projections 80 may be provided on the inner circumferential face of the fixing member 28 and the pair of engagement grooves 84 may be provided on the outer circumferential face of the mover 27.

In the present embodiment, an entire part of the conveyer 23 is stored in the case main body 21. On the other hand, in another embodiment, a part of the conveyer 23 may be stored in the case main body 21.

In the present embodiment, a part of the transmitter 30 is exposed to the outside of the case main body 21. On the other hand, in another embodiment, an entire part of the transmitter 30 may be exposed to the outside of the case main body 21.

In the present embodiment, the main body part 65 of the shutter 26 is rotatably attached to the inner circumference of the duct 38 of the case main body 21. On the other hand, in another embodiment, the shutter 26 may be rotatably attached to the outer circumference of the duct 38 of the case main body 21.

In the present embodiment, the conveyer 23 is an example of the rotator. On the other hand, in another embodiment, the agitator 22 or the others may be an example of the rotator.

In the present embodiment, the discharge port 45 of each toner container 15 is connected to the developing device 8 of each image forming part 6 via the replenishment duct (not shown). On the other hand, in another embodiment, the discharge port 45 of each toner container 15 may be directly connected to the developing device 8 of each image forming part 6.

In the present embodiment, the lever 24 of each toner container 15 is connected to the shutter 26 via the connecting mechanism 120 of the attachment part 16. On the other hand, in another embodiment, the lever 24 of each toner container 15 may be directly connected to the shutter 26.

In the present embodiment, the configuration of the present disclosure is applied to the multifunctional peripheral 1. On the other hand, in still another embodiment, the configuration of the present disclosure may be applied to an image forming apparatus, such as a printer, a copying machine and a facsimile, other than the multifunctional peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body having a discharge port through which a toner is discharged;

a rotator stored in the case main body and rotating around a rotation axis;

a transmitter which transmits rotation to the rotator, at least a part of the transmitter being exposed to an outside of the case main body; and a shutter rotatable between a closing position where the shutter closes the discharge port and an opening position where the shutter opens the discharge port, wherein the transmitter is movable between a first position and a second position which is arranged at an outside of the first position in a rotation axis direction of the rotator, the toner case further comprising a mover which is restricted from rotating with respect to the case main body and movable along the rotation axis direction, wherein the rotator is movable along the rotation axis direction, the transmitter is fixed to the rotator, and as the shutter rotates from the closing position to the opening position, the shutter presses the mover to move the mover to one side in the rotation axis direction, the mover presses the rotator to move the rotator to the one side in the rotation axis direction, and the transmitter fixed to the rotator moves from the first position to the second position.

2. The toner case according to claim 1, wherein the shutter has a pressing face inclined to the one side in the rotation axis direction from a downstream side toward an upstream side in a rotating direction of the shutter from the closing position to the opening position, the mover has a pressed face inclined to the one side in the rotation axis direction from the downstream side toward the upstream side in the rotating direction, and as the shutter rotates from the closing position to the opening position, the pressing face presses the pressed face to move the mover to the one side in the rotation axis direction.

3. The toner case according to claim 1, further comprising a fixing member which stores the mover and is fixed to the case main body, wherein one of an outer circumferential face of the mover and an inner circumferential face of the fixing member has an engagement groove, and another of the outer circumferential face of the mover and the inner circumferential face of the fixing member has an engagement projection which is engaged with the engagement groove in a movable state along the rotation axis direction.

4. The toner case according to claim 3, wherein the case main body has a fixed groove at an outer edge in the rotation axis direction, the fixing member includes:

a storage piece which stores the mover; and a fixed piece protruding to an outside in a radial direction from the storage piece and engaging with the fixed groove.

5. The toner case according to claim 1, wherein a plurality of projections are formed on an outer circumferential face of the rotator at equal intervals in a circumferential direction, and when the mover moves to the one side in the rotation axis direction, the mover presses the plurality of projections.

6. The toner case according to claim 1, further comprising a biasing member which biases the transmitter to the first position, wherein as the shutter rotates from the opening position to the closing position, the transmitter moves from the second position to the first position by biasing force of the biasing member.

7. The toner case according to claim 6, wherein the transmitter and the biasing member are arranged at one end side of the rotator in the rotation axis direction, and the shutter is arranged at another end side of the rotator in the rotation axis direction.

8. The toner case according to claim 1, wherein the case main body includes a cylindrical duct having the discharge port, the rotator is a conveyer which conveys the toner in the case main body toward the discharge port, at least a part of the conveyer being stored in the duct, and the shutter is rotatably attached to the duct.

9. The toner case according to claim 8, wherein the shutter includes:

a main body part rotatably attached to an inner circumference of the duct; and a closing part which closes an end of the main body part at an outside in the rotation axis direction.

10. An image forming apparatus comprising:

the toner case according to claim 1; and an attachment part to which the toner case is detachably attached.

11. The image forming apparatus according to claim 10, wherein the transmitter includes a transmitting coupling, the attachment part includes a driving coupling which is rotated by driving force of a driving source, and when the transmitter moves from the first position to the second position in a state where the toner case is attached to the attachment part, the transmitting coupling is coupled to the driving coupling.

12. The image forming apparatus according to claim 10, wherein the toner case further includes a manipulation member rotatably supported by the case main body, and the attachment part includes a connecting mechanism which connects the manipulation member to the shutter, wherein when the manipulation member is rotated in a state where the toner case is attached to the attachment part, rotation of the manipulation member is transmitted to the shutter via the connecting mechanism to rotate the shutter.

* * * * *